US008734370B1

(12) United States Patent
Ignagni

(10) Patent No.: US 8,734,370 B1
(45) Date of Patent: May 27, 2014

(54) DEVICE FOR CLEARING MUCUS FROM THE PULMONARY SYSTEM

(71) Applicant: Mario Battiste Ignagni, Brooklyn Park, MN (US)

(72) Inventor: Mario Battiste Ignagni, Brooklyn Park, MN (US)

( * ) Notice: Subject to any disclaimer, the term of this patent is extended or adjusted under 35 U.S.C. 154(b) by 0 days.

(21) Appl. No.: 13/815,953

(22) Filed: Mar. 18, 2013

Related U.S. Application Data

(63) Continuation-in-part of application No. 11/803,257, filed on May 14, 2007, now Pat. No. 7,927,293.

(51) Int. Cl.
*A61H 1/00* (2006.01)
*A61H 7/00* (2006.01)
*A61H 9/00* (2006.01)

(52) U.S. Cl.
USPC ..... 601/152; 601/149; 601/150

(58) Field of Classification Search
USPC ..... 601/9, 11, 46, 48, 148–152, 41, 44, 601/DIG. 6, DIG. 7; 137/625.5
See application file for complete search history.

(56) References Cited

U.S. PATENT DOCUMENTS

| | | | | | |
|---|---|---|---|---|---|
| 3,955,563 | A | | 5/1976 | Maione | |
| 4,225,989 | A | * | 10/1980 | Corbett et al. | 5/713 |
| 4,234,015 | A | * | 11/1980 | Kintner | 137/625.18 |
| 4,280,487 | A | * | 7/1981 | Jackson | 601/150 |
| 4,838,263 | A | | 6/1989 | Warwick et al. | |
| 5,056,505 | A | * | 10/1991 | Warwick et al. | 601/44 |
| 5,235,967 | A | | 8/1993 | Arbisi et al. | |
| 5,569,170 | A | | 10/1996 | Hansen | |
| 5,876,359 | A | * | 3/1999 | Bock et al. | 601/150 |
| 6,119,291 | A | * | 9/2000 | Osborne et al. | 5/600 |
| 6,190,337 | B1 | * | 2/2001 | Nedwell | 601/46 |
| 6,547,749 | B2 | * | 4/2003 | Hansen | 601/48 |
| 6,736,785 | B1 | | 5/2004 | Van Blunt | |
| 6,958,046 | B2 | | 10/2005 | Warwick et al. | |
| 6,969,365 | B2 | * | 11/2005 | Scorvo | 602/16 |
| 7,096,866 | B2 | | 8/2006 | Be'eri et al. | |
| 7,278,978 | B1 | * | 10/2007 | Hansen et al. | 601/41 |
| 7,416,536 | B2 | | 8/2008 | DeVlieger | |
| 7,927,293 | B1 | | 4/2011 | Ignagni et al. | |
| 8,273,039 | B1 | | 9/2012 | Ignagni | |
| 2002/0107461 | A1 | * | 8/2002 | Hui | 601/149 |
| 2002/0111571 | A1 | | 8/2002 | Warwick et al. | |
| 2003/0155019 | A1 | * | 8/2003 | Hess et al. | 137/625.5 |
| 2004/0158177 | A1 | | 8/2004 | Van Brunt et al. | |
| 2004/0260218 | A1 | * | 12/2004 | Shah et al. | 601/152 |
| 2005/0240128 | A1 | * | 10/2005 | Shabty et al. | 601/150 |
| 2006/0089575 | A1 | * | 4/2006 | DeVlieger | 601/70 |
| 2006/0149176 | A1 | * | 7/2006 | Bolam et al. | 601/152 |
| 2007/0239087 | A1 | | 10/2007 | Kivisto | |

* cited by examiner

*Primary Examiner* — Justine Yu
*Assistant Examiner* — Christopher Miller

(57) ABSTRACT

A device is disclosed for generating controlled pneumatic pressure to a human body to achieve mucus clearance from the pulmonary system. Controlled pneumatic pressure consisting of individual vibratory pressure and constrictive pressure variations are generated and applied to the thorax to promote mucus clearance. The vibratory pressure variation is channeled to a pressure receiver secured to the upper thorax of the body, and the constrictive pressure variation is channeled to a pressure receiver secured to the lower thorax of the body. The vibratory pressure variation serves to loosen the mucus, while the constrictive pressure variation provides the motive force that promotes mucus expulsion from the pulmonary system.

9 Claims, 5 Drawing Sheets

DEVICE FOR CLEARING MUCUS FROM THE PULMONARY SYSTEM

CROSS REFERENCE TO PRIOR APPLICATION

This application is a continuation-in-part of U.S. patent application Ser. No. 11/803,257, entitled "Means For Clearing Mucus From the Pulmonary System", filed May 14, 2007, now U.S. Pat. No. 7,927,293 B1, issued Apr. 19, 2011, and U.S. patent application Ser. No. 12/319,169 "Apparatus for Clearing Mucus From the Pulmonary System", now U.S. Pat. No. 8,273,039, issued Sep. 25, 2012.

FIELD OF THE INVENTION

The invention generally relates to the use of pneumatic pressure stimulations to the human body in promoting clearance of mucus from the lungs and trachea, or to achieve other potential therapeutic benefits.

BACKGROUND OF THE INVENTION

A number of diseases can lead to severe impairment of normal lung functioning. Among these are: Cystic Fibrosis, Emphysema, and Immotile Cilia Syndrome. Cystic Fibrosis is a hereditary disease that leads to the accumulation of large quantities of viscous mucus in the lungs. Emphysema causes impairment of the lung's ability to clear mucus as a result of damage to the cilia, the small hair-like vibrating appendages covering the lung wall that loosen and help propel the mucus out of the lung; and damage to the alveoli, the small air sacs covering the lung surface, which are instrumental in coughing mucus out of the lungs. Immotile Cilia Syndrome is a hereditary disease in which the normal functioning of the cilia is absent or impaired, leading to the accumulation of mucus in the lungs. In all of these diseases, mucus retained in the lungs becomes a natural breeding ground for harmful bacteria that can cause repeated bouts of serious infections, as well as leading to decreased respiratory gas exchange.

In addition to drugs and inhalants, various physical therapies may be applied to assist in expelling mucus from the pulmonary system. In particular, patients may undergo chest percussion by a trained physical therapist to loosen lung mucus, which is followed by postural drainage and coughing to expel the mucus from the lungs. This can be a time consuming and discomforting therapy which meets with only limited success, especially if the patient is in a weakened condition.

More recently, high-frequency chest compression techniques have been employed as a means of eliminating the need for a physical therapist, and to improve effectiveness of mucus clearance from the lungs. Such techniques have been taught by Warwick and Hansen, U.S. Pat. No. 4,838,263; Hansen, U.S. Pat. No. 5,569,170; and Warwick and Hansen, U.S. Pat. No. 6,958,046. High-frequency chest compression, as applied by an inflatable vest, has been shown in clinical trials and in actual use to be efficacious in clearing mucus from the lungs. However, a patient may require 2 to 3 hours of treatment each day to keep the lungs relatively free of mucus.

The present invention addresses the need for a more effective approach to clearing mucus from the pulmonary system that will reduce physical stress to the body, and require less time in the daily regimen of treatment, as well as promoting other potential health benefits.

BRIEF SUMMARY OF THE INVENTION

A first controllable excitation source applies vibrational stimulations directly to the thorax which, in turn, causes the pulmonary system to develop small-amplitude sympathetic vibrations, thereby loosening the mucus attached to the lungs and trachea. A second independently controllable excitation source applies compressive stimulations to the patient just below the rib cage, leading to upward thrusts of the thoracic diaphragm. Since the lungs rest directly on the thoracic diaphragm, localized motions of the lung walls will be initiated at the points of contact. This causes the air in the lungs to experience pressure and flow-rate pulsations which, in turn, cause the mucus attached to the lungs and trachea to be propelled in incremental steps toward the mouth. Control means are provided to insure that efficacious pulmonary system vibration and thoracic compressions are achieved without undue stress to the patient. The use of two separately controllable thoracic excitation sources offers greater potential for optimization than a single excitation, as applied by existing high-frequency chest compression techniques, and may have advantages in size, cost, mucus clearance rate, and reduced physical stress to the body.

DETAILED DESCRIPTION OF THE INVENTION

Figure 1:
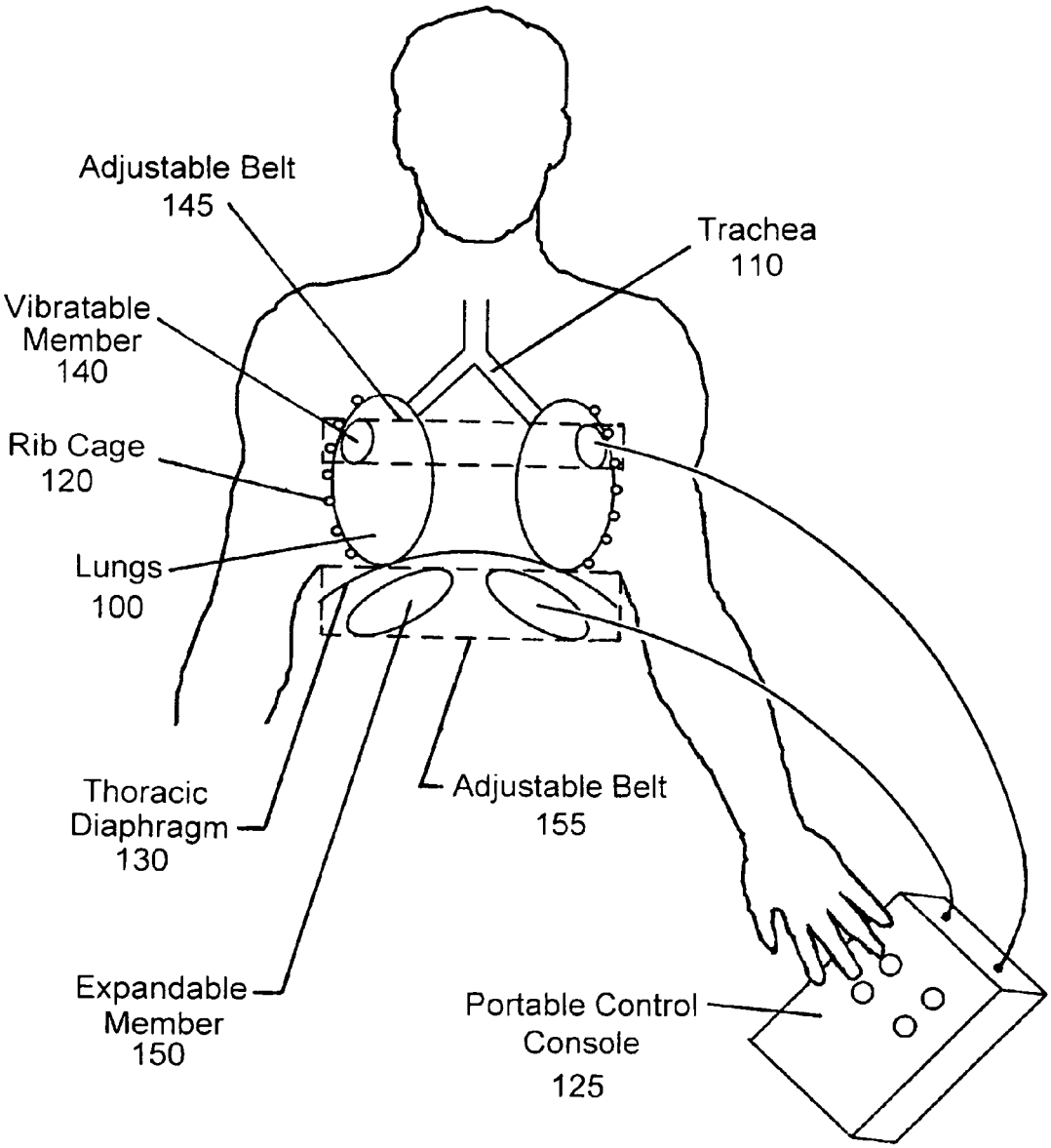
FIG. 1 illustrates parts of the body which are generally affected by the external excitations, and the sources of the excitations.

FIG. 1 illustrates the concept for clearing the lungs 100 and trachea 110 of mucus. The concept is based on the employment of two separately controllable excitations, in combination, to maximize the effectiveness of mucus clearance from the pulmonary system. The first excitation augments the action of the cilia by inducing sustained low-amplitude high-frequency vibrations in the lungs 100. This serves to create continuous oscillatory translational motions of the lung wall relative to the mucus which, in turn, expedites movement of the mucus. Vibration of the lung walls is achieved by employing at least one vibratable member 140 held in contact with the thorax. From a physical perspective, the lung wall behaves essentially like a perfect elastic membrane, while the mucus does not. Accordingly, because the lung wall and mucus respond differently in a vibrational environment, relative motion will occur between them, which creates a boundary layer of lower viscosity mucus adjacent to the lung wall, thereby increasing mucus mobility.

Given that sustained vibration of the lung wall expedites the movement of mucus, the second function of propelling the mucus along the lung wall is achieved by mechanically pumping the air in the lungs 100 utilizing compressive stimulations of the lower thorax, characterized by a much higher amplitude and lower frequency than the vibrational stimulations. Compression of the lower thorax is achieved by employing at least one expandable member 150 held in contact with the thorax, which leads to upward thrusts of the thoracic diaphragm 130. The pressure and flow-rate variations of the air enclosed within the lungs 100, induced by the upward thrusts of the thoracic diaphragm, create the motive forces required to propel the mucus in incremental steps toward the mouth, where it can be swallowed or expectorated.

The first excitation means for applying vibrational stimulations to the thorax can take various forms. In one exemplary application, the vibrational stimulations could be applied by one or more mechanical vibrators which transmit inertial reaction forces to the thorax. In still another exemplary application, the vibrational stimulations could be applied by sonic waves originating from one or more audio speakers. In yet another exemplary application, the vibrational stimulations could be applied by an inflatable pneumatic belt or cuff that causes oscillatory compressive forces to be transmitted to the thorax. More than one vibration-generating device would typically be utilized, with vibration applied symmetrically to the thorax, allowing the lungs 100 and the trachea 110 to be stimulated. In one exemplary application, the vibration-generating devices would be held in contact with the thorax by an adjustable belt 145. In still another exemplary application, the vibration-generating devices would be attached to the back or side of a chair, and the thorax positioned such that direct contact is maintained with the vibration generators.

Since each patient generally responds differently to external vibrational stimuli, control means are required to regulate these stimulations, such that the vibrations transmitted to the pulmonary system are effective in increasing the mobility of the mucus attached to the lungs 100 and trachea 110 without causing undue stress to the patient. This will depend both on the degree of mucus congestion, and on the mechanical properties of the lungs 100 and rib cage 120. For example, the lung resonant frequency of a small child will be approximately twice that of an adult. Furthermore, the lung resonant frequency will generally be significantly different when the lungs 100 are congested with mucus. A second physical difference between patients is the rib-cage resonant frequency, which has an important influence on the efficacy of the vibrational stimulations. Since the lungs 100 can be vibrated both directly, and indirectly as a response to vibration of the rib cage 120, mucus loosening will benefit from both types of excitation. Also, generally, for a given spectral content of the vibrational energy transmitted to the thorax, efficacy of mucus clearance from the lungs 100 and trachea 110 will depend directly on the intensity of the vibrations, which should be subject to regulation by the patient or caregiver to achieve the desired benefit without undue stress.

Regulation of the vibrational stimulations is achieved by employing a portable control console 125 operated by the patient or caregiver. This would generally include the ability to regulate the vibration spectrum applied to the thorax, as well as the intensity of the vibrations. It is also important that the patient or caregiver be given the means to terminate the vibrational excitations, both as a safety measure, and to allow the patient time to rest or cough. Application of vibration during the inspiration phase of the breathing cycle may also be undesirable for some patients, and could be discontinued during this part of the respiratory cycle.

The application of vibration to the pulmonary system causes a significant increase in the mobility of the mucus attached to the lungs 100 and trachea 110; however, in itself, the vibration has little potential for expelling mucus from the pulmonary system. To accomplish the latter, a second type of excitation is required which applies compressive stimulations to the lower thorax, inducing a series of huffs. Application of compressive stimulations to the lower-thoracic region can be achieved by various means. In one exemplary application, an electromechanical actuator would be used to apply compressive forces directly to the thorax. In still another exemplary application, the compressive stimulations would be transmitted by means of one or more inflatable bladders held against the thorax by an adjustable belt 155, and pressurized by a controlled source of pneumatic pressure. In yet another exemplary application, the compressive stimulations would be transmitted by means of a single inflatable cuff or belt, secured around the lower thorax, and pressurized by a controllable source of pneumatic pressure As in the case of the vibrational stimulations, the compressive stimulations need to be controlled to reflect patient-specific requirements, and to achieve overall efficacy without discomfort to the patient. The objective of the control scheme is to regulate the compressions of the lower-thoracic region in a manner which creates simultaneous increases in the pressure and expiration rate of air contained within the lungs 100 and trachea 110, thereby leading to a series of huffs. Then, together with concurrent application of the vibrational stimulations, the compressive stimulations will cause the desired incremental movements of the mucus along the lung and tracheal walls. Generally, compressive stimulations would be applied only during the expiration phase of the respiratory cycle, and inhibited by the patient or caregiver during the inspiration phase. The control console 125 provides the means by which the patient or caregiver may regulate the compressive stimulations to the lower thorax.

Preferred Embodiment of the Invention

Various mechanization approaches may be used in implementing vibratory, compressive and composite pressure stimulations to the body, each having unique safety, adaptability and cost characteristics. From a safety perspective, pneumatic stimulation has an advantage in that no electrified elements are in contact with the body. Furthermore, there is a greater ability to prevent bodily injury from a runaway actuator when pneumatic pressure is utilized as the source of the stimulations. The adaptability of the device, defined as its ability to effectively satisfy a spectrum of user needs, will generally differ from one implementation to another. Typically, there will be a tradeoff between the cost of the device and its adaptability. For example, cost may be reduced if the device is limited to a single composite stimulation, consisting of vibratory and compressive component. However, from an adaptability perspective, doing so may impose an undesirable restriction for some users.

The preferred embodiment of the invention allows individual vibratory and compressive stimulations to be provided at separate sites on the thorax, as well as a composite stimulation consisting of vibratory and compressive components to be provided to the lower-thoracic region, thereby insuring maximum adaptability. To reduce cost, an approach may be used in which a single pressure generator is used to create both the vibratory and constrictive pressure variations, which are applied in an alternating manner between sites on the upper and lower thorax.

Figure 2:
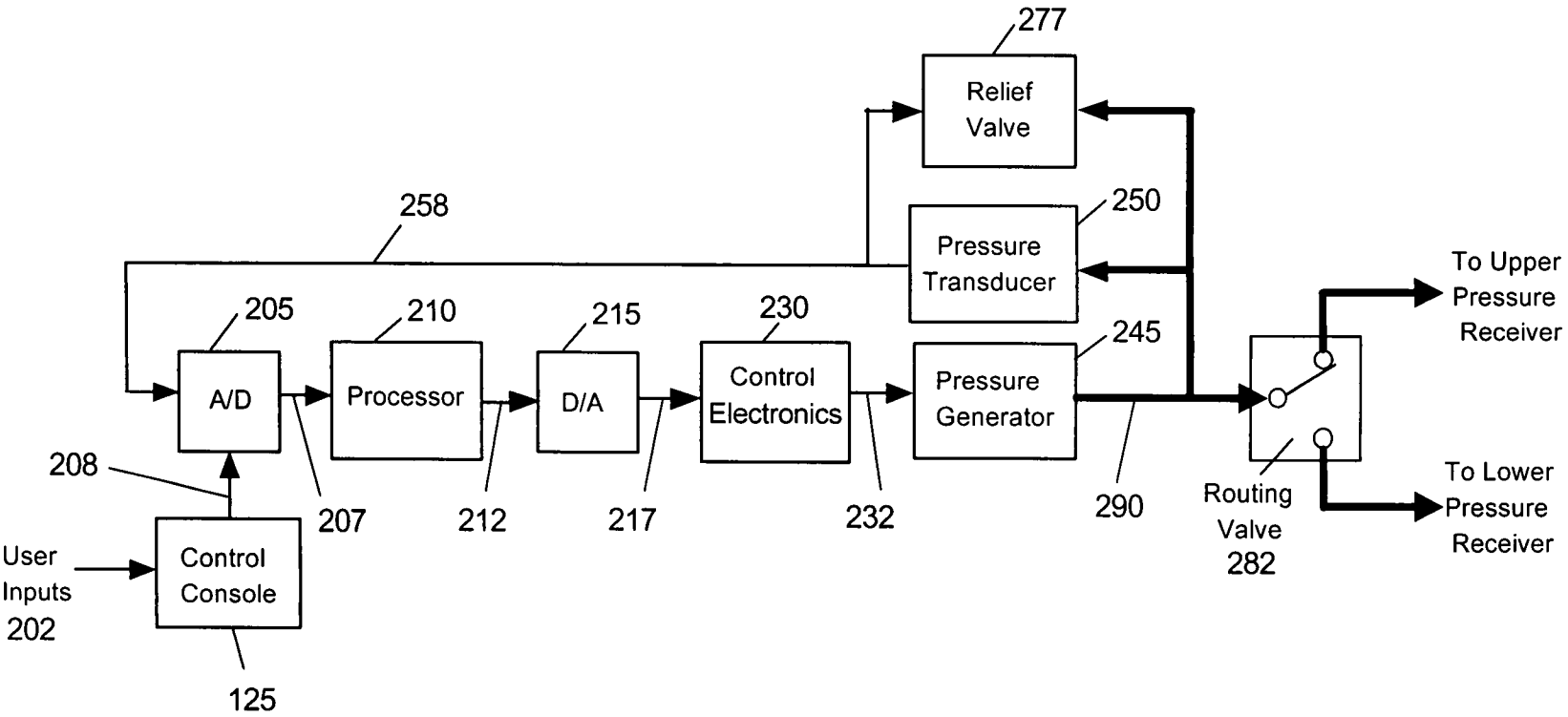
FIG. 2 shows a generalized block diagram of a device for generating vibratory and constrictive pressure outputs or, alternatively, a composite pressure output consisting of combined vibratory and constrictive components.

FIG. 2 defines a generalized mechanization diagram for this preferred embodiment. The system consists of a pneumatic pressure generator 245 which creates time-varying output-pressure variations. The pressure generator is capable of creating a high-frequency vibratory pressure variation, a low-frequency compressive pressure variation, hereafter referred to as a constrictive pressure variation, and a composite pressure variation in which both of these pressure variations are superimposed. In one exemplary application, the pressure generator would be implemented using an air compressor to maintain a controlled source of pneumatic pressure within a pressure vessel, together with a valve in communication with the pressure vessel and the atmosphere for controlling the input and venting of the air within the pressure generator. In still another exemplary application, the pressure generator would be implemented using an air cylinder which acts like a piston pump to create the desired time-varying pressure variation.

A pressure transducer 250 monitors the pressure in the pressure generator 245, which provides the means for maintaining closed-loop control of the system, and insures that any system failure which causes an excessive pressure level will be quickly detected. A relief valve 277 is used to dissipate the pressure applied to the body if an unsafe pressure level has been detected via the pressure transducer 250.

An analog-to-digital converter 205 is used to acquire an analog signal 258 from the pressure transducer 50, and to generate a digital input signal 207 to the processor 210. The processor 210, in turn, outputs a digital signal 212 to a digital-to-analog converter 215, which provides a control input signal 217 to control electronics 230. Control electronics 230 generates an electrical activation signal 232 for the pressure generator 245. The processor 210 hosts the necessary algorithms to implement the control laws required to maintain closed-loop control of the system. The output pressure 290 of the pressure generator 245 is applied to a routing valve 282 which has two possible output ports, which makes it possible to transmit the pressure generator output to two different points on the thorax in an alternating pattern. The routing valve is synchronized to the pressure generator so that a vibratory pressure variation to the upper thorax is alternated with a constrictive pressure variation to the lower thorax; or, alternatively, a composite pressure variation is applied to the lower thorax. Cyclic pressure alternation would consist of applying a vibratory pressure to the upper thorax during inspiration, and a constrictive pressure to the lower thorax during expiration.

The ability to set up different pressure outputs is carried out using control console 125. The control console 125 is activated by the user or caregiver via a set of user inputs 202, and has a plurality of accessible control settings, whereby a desired vibratory pressure variation and a desired constrictive pressure variation may be specified. For the vibratory pressure variation, the control settings allow the amplitude and frequency characteristics to be selected. For the constrictive pressure, the control settings allow the temporal characteristics of the variation to be selected, which could be defined by an amplitude and frequency, or by an amplitude, rise time, duration and decay time. These characteristics 208 are conveyed to the processor 210 via analog-to-digital converter 205.

In the therapeutic application of interest, one or more air hoses would typically be used to convey the air pressures generated by the apparatus to one or more suitably chosen pressure receivers held in contact with the thorax by one or more adjustable belts. If vibratory pressure stimulations to the lower thorax cannot be tolerated by the patient, composite pressure to the lower thorax would not be administered. Similarly, if constrictive pressure stimulations to the lower thorax cannot be tolerated by the patient, only vibratory pressure to the upper thorax would be administered, either through a cuff or a vest having a non-extensible outer layer.

Figure 3:
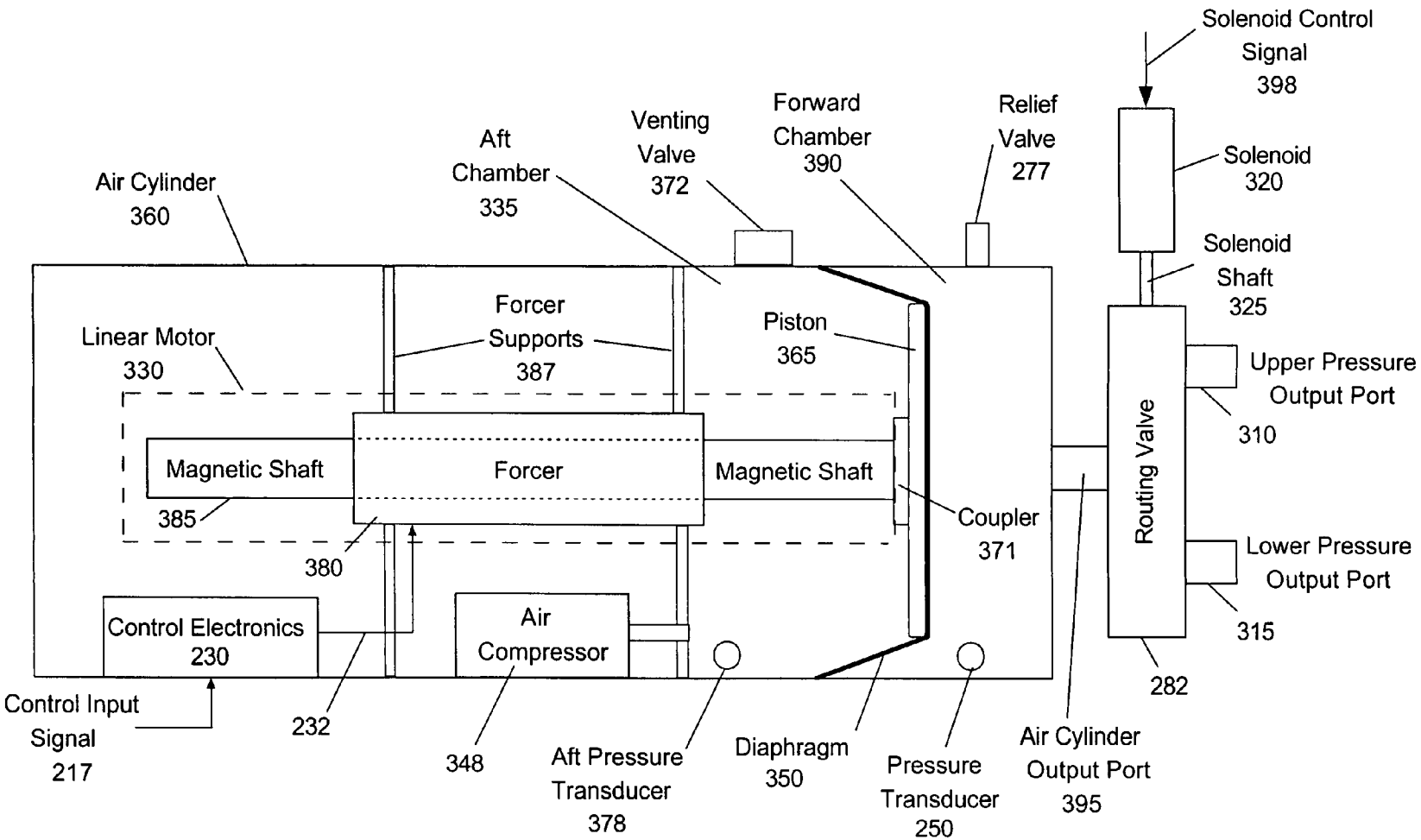
FIG. 3 shows a mechanization diagram for a preferred embodiment of a concept for the generation of vibratory, constrictive and composite pneumatic pressure variations to the human body.

FIG. 3 is a detailed mechanization diagram for implementing the vibratory, constrictive and composite pressure-generation functions. In this preferred embodiment, the system consists of a single air cylinder, which functions as a piston pump to create the desired time-varying output pressure variation. The air cylinder 360 creates a desired pressure variation in its forward chamber 390 when its piston 365 executes translational motion. This is accomplished using a linear motor 330 to apply a force to the piston 365. The linear motor is essentially a rotary motor that is opened up and laid out in such a manner as to produce linear motion as opposed to rotational motion, and consists of two parts: a magnetic shaft 385, and a forcer 380. The magnetic shaft 385 is made up of an array of permanent magnets, and the forcer 380 is made up of one or more windings which are electrically energized. The interaction between the current in the windings of the forcer 380 and the magnetic shaft 385 causes a force to be transmitted to the magnetic shaft, which is free to translate and move a load. The linear motor, which is supported and centered within the air cylinder 360 by means of supports 387, is used to achieve a required piston stroke, at a required velocity and force.

The linear motor has a unique capability relative to other linear actuators, insofar as it has the ability to execute long, low-frequency strokes, as required for generating constrictive pressure variations, and short strokes at high frequencies for the vibratory pressure variations. A single composite pressure variation, utilizing both capabilities of the linear motor simultaneously, is also easily achieved. This makes the linear motor an ideal actuator for generating the desired pneumatic pressure variations to the body.

The translation of the linear motor 330 magnetic shaft is transmitted to the piston 365 via a coupler 371. Control electronics 230 generates an electric current 232 input to the windings of the forcer 380 which, in turn, causes a force to be applied to piston 365 via magnetic shaft 385 and coupler 371. The resultant motion of the piston 365 leads to a variation in the volume of the cylinder's forward chamber 390, which results in the desired pressure variation. A diaphragm 370 provides an airtight seal between the aft chamber 335 and the forward chamber 390 of the air cylinder 360. The diaphragm may take the form of a "rolling diaphragm", or other available types that are suitable for large displacements. The control signal input 217 to control electronics 230 activates the linear motor 330. A routing valve 282 is used to direct the pressure outputs of the device to one or more sites on the thorax. Depending on the state of the routing valve 282, the output pressure of the air cylinder 360 may be channeled either to the upper thorax or to the lower thorax.

An optional air compressor 348 in fluid communication with the aft chamber 335 of air cylinder 360 may be incorporated, as shown in FIG. 3, to off-load the linear motor in generating a constant steady-state biasing force to piston 365. An aft pressure transducer 378 for measuring the pressure in the aft chamber 335, and a venting valve for relieving the air pressure in the aft chamber are also provided. A set of algorithms hosted in processor 210, operative upon the measurement from the aft pressure transducer 378, generates control signals to activate and de-activate the air compressor 348 and venting valve 378, and thereby maintain the pressure in the aft chamber at a desired constant value. The algorithm forms the difference between the desired pressure and the measured pressure in the aft chamber 335 and, based upon this pressure difference, turns the air compressor 348 on or off, or opens or closes the venting valve 372.

Figure 4:
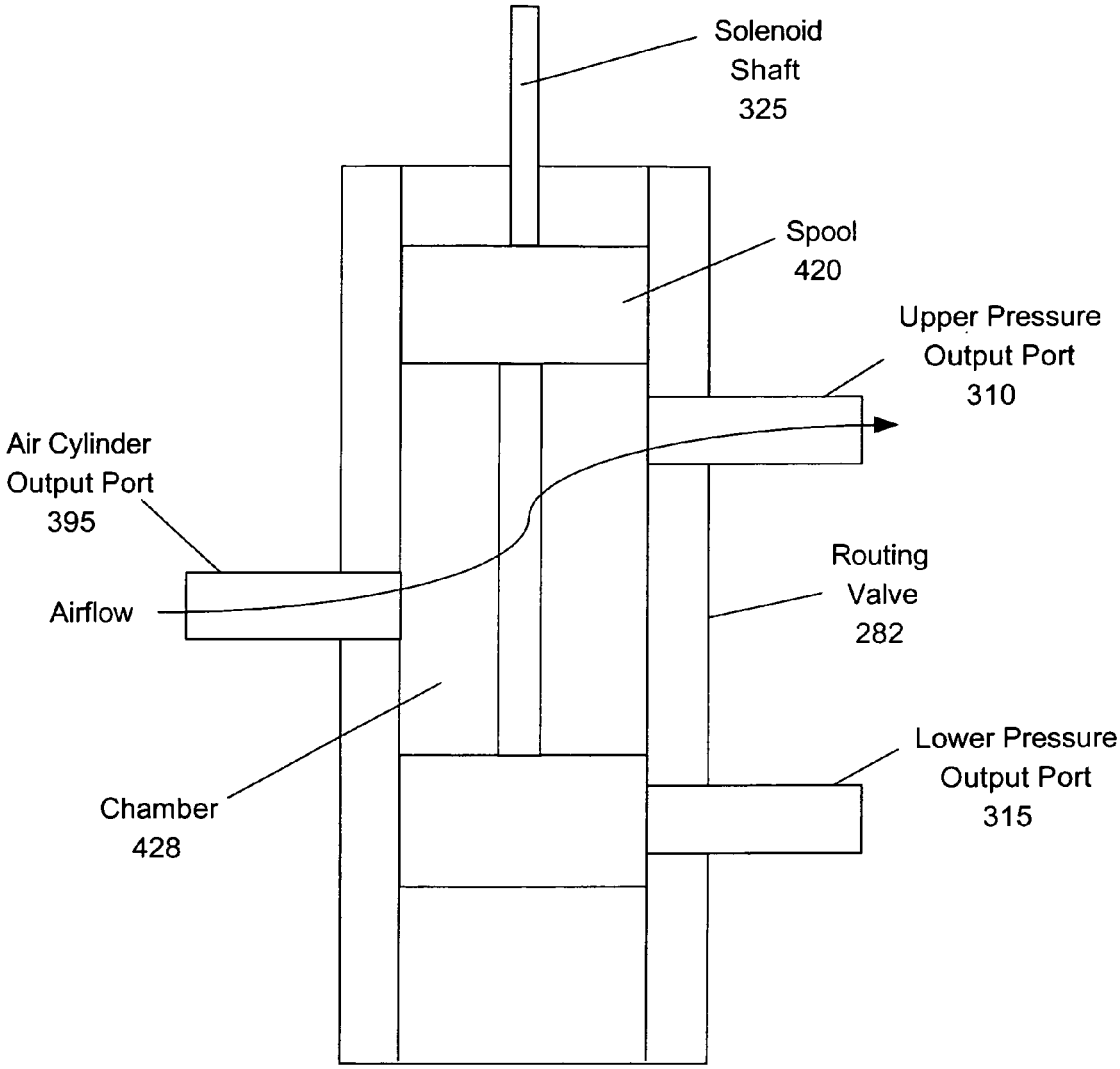
FIG. 4 shows a routing valve used to channel the pressure output of the device to a specific site on the body.

The routing valve 282 may have a number of different embodiments. FIG. 4 provides details of a preferred embodiment of the routing valve, which consists of a solenoid driven spool valve. The output port 395 of air cylinder 360 provides the input to routing valve 282. Then, depending on the position of the spool 420, the pressure output is directed to either upper pressure output port 310, or lower pressure output port 315 via chamber 428.

A solenoid 320 is used to control the routing valve 282 such that the air flow from air cylinder 360 is channeled to upper pressure output port 310, or lower pressure output port 315. The solenoid shaft 325 positions the spool 420 to allow the desired output port to be in fluid communication with the air cylinder output port 395. A solenoid control signal 398 is used to position a moveable shaft 325 which controls the air flow through the routing valve 282, based on a control signal provided by processor 210.

The physical characteristics of air cylinder 360 are chosen such that it can generate vibratory pressure variations having a spectral content substantially contained within the frequency range 5 to 20 Hz, and constrictive pressure variations having a spectral content substantially contained within the frequency range 0 to 5 Hz. These frequency ranges are chosen to maximize the potential of the device to provide a useful repertoire of therapeutic stimulations while, at the same time, recognizing practical design limitations. In applying therapeutic pressure stimulations to humans, both children and adults, safety must be guaranteed. This necessitates precise control, with the ability to terminate the pressure stimulations if an unsafe level arises. Also, efficacy of the therapy requires that the stimulations be well articulated. To achieve both safety and efficacy, a closed-loop approach is required. This, in turn, requires continuous pressure monitoring, together with a set of real-time control algorithms for generating control signals to the linear motor. Closed-loop control allows the pressure variations transmitted to the pressure receivers to be regulated in a manner which insures that the desired pressure stimulations to the body are achieved in a safe and predicable manner. Contemporary digital processor technology allows sophisticated real-time closed-loop control algorithms to be implemented.

Figure 5:
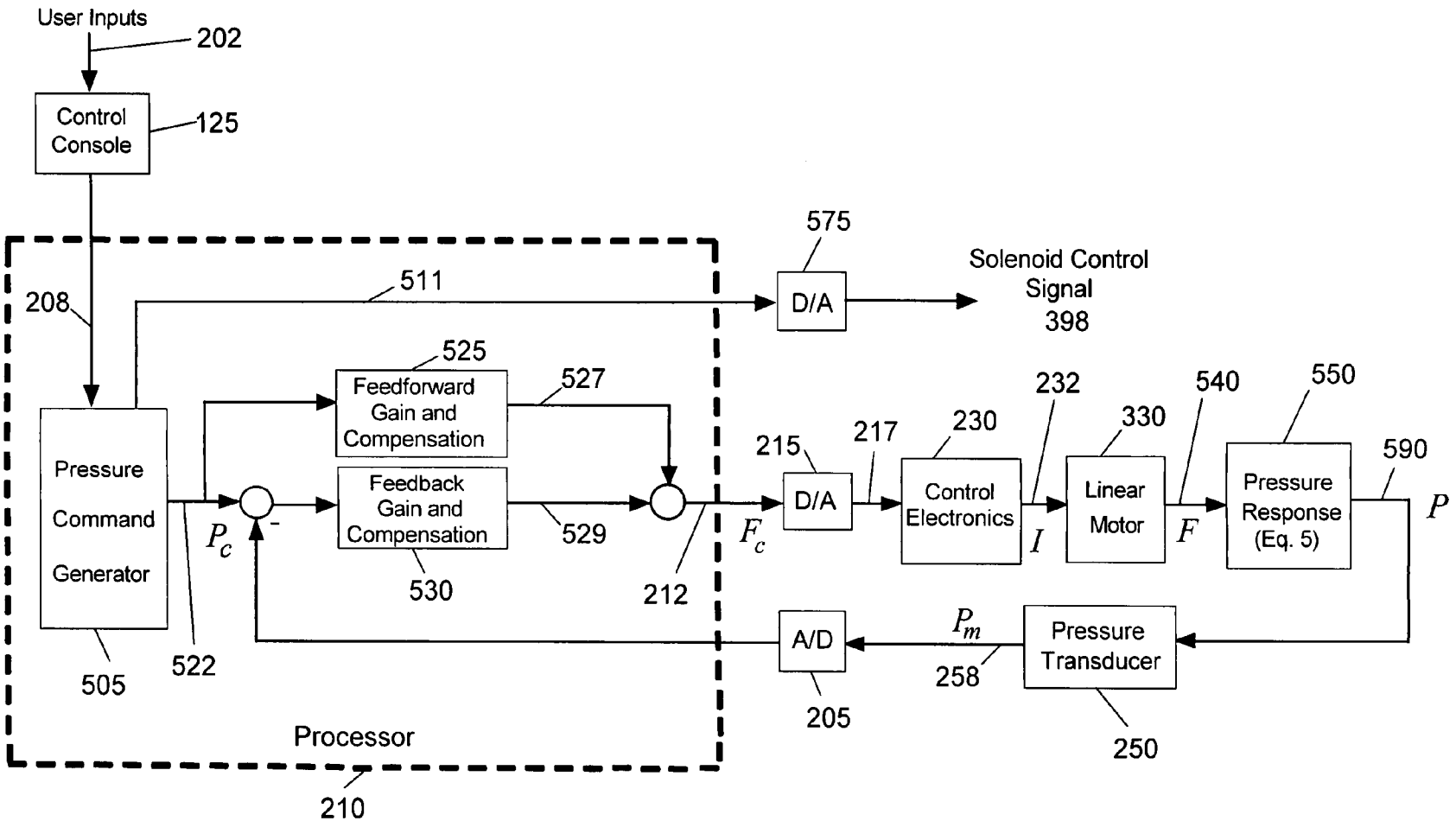
FIG. 5 shows a block diagram for implementing closed-loop control of the pressure-generation function of the preferred embodiment.

FIG. 5 provides a block diagram for implementing closed-loop control of the pressure output of air cylinder 360. A basic principle utilized in the control scheme is Boyle's Gas Law for a confined gas. From Boyle's Gas Law, the following relationship is true $$PV^{\gamma}=C \tag{1}$$

where P is gas pressure, V is gas volume, and γ is a constant ranging from 1.0 for isothermal expansion/contraction to 1.4 for adiabatic expansion/contraction, and C is a constant. In the present application, the confined gas volume consists of the combined volume of the cylinder forward chamber, connecting hose and pressure receiver.

The incremental pressure to incremental stroke gain for the cylinder forward chamber, connecting hose and pressure receiver combination may be derived directly from (1), and is given by:

$$\frac{\Delta P}{\Delta x} = K_p = \frac{\gamma A P}{\gamma c P + V_0 (P_0 / P)^{1/\gamma}} \tag{2}$$

where

- Δx=incremental piston stroke
- ΔP=incremental cylinder output pressure
- A=piston area
- c=composite compliance coefficient for the pressure receiver and area of pressure application on the body
- $V_0$=quiescent volume of pressure output chamber, hose and pressure receiver
- $P_0$=quiescent pressure of pressure output chamber, hose and pressure receiver and the quiescent pressure and volume are understood to be the corresponding values of P and V when the piston is in its starting position. The incremental pressure to incremental stroke gain, $K_p$, is a fundamental parameter in the control scheme. Another useful form of (2) is the following:

$$\frac{\dot{P}}{\dot{x}} = K_p \tag{3}$$

where

- $\dot{P}$=rate of change cylinder output pressure
- $\dot{x}$=rate of change of piston stroke and $K_P$ is as defined in (2). Equation (3) defines the pressure response transfer function utilized in the pressure control concept illustrated in FIG. 5.

For air cylinder 360, a transfer function relating the translational motion of the piston to the applied force is required. This transfer function is based on a force balance for the piston 365, together with the restraining effect of the air entrapped in the air cylinder forward chamber, hose and pressure receiver. The relevant transfer function is defined as follows:

$$x(s) = \left(\frac{1}{ms^2 + fs + aK_p}\right)F(s) \tag{4}$$

where the following definitions apply

- x(s)=piston linear translation
- F(s)=force applied to piston
- $K_P$=incremental pressure to incremental stroke gain
- a=area of piston in air cylinder
- m=mass of piston, actuator output shaft and coupler
- f=damping force coefficient, resulting from viscous friction and actuator back emf
- s=Laplace complex operator A transfer function relating the pressure output to the force input may then be defined by $$P(s) = \left(\frac{K_p}{ms^2 + fs + aK_p}\right)F(s) \tag{5}$$

where P(s) is the output pressure of air cylinder 360. The transfer function given by (5) defines the pressure response transfer function appearing in FIG. 5. This transfer function, in turn, provides the basis for a transfer function relating the amplitude of a sinusoidal output pressure to the amplitude of a sinusoidal force input, which is as follows:

$$A_P(\omega) = \left(\frac{K_p}{[(aK_p - m\omega^2)^2 + f^2\omega^2]^{1/2}}\right)A_F(\omega) \tag{6}$$

where

- $A_p$=amplitude of the vibratory pressure output
- $A_F$=amplitude of the force input
- ω=angular rate of the vibratory pressure output The relationships defined by Equations (1) through (6) are based on fundamental pneumatic principles discussed in detail in: "The Analysis and Design of Pneumatic Systems, by B. W. Andersen, Krieger. Publishing Company, 2001, ISBN 1-57524-164-1, and elsewhere.

Referring to FIG. 5, it is seen that the software embedded in the processor includes a pressure command generator module 505, which operates upon a set of user inputs 202, introduced via control console 125. The user input data would consist of information defining the temporal variation parameters of the desired vibratory and constrictive pressures, together with timing parameters that define the switching schedule for the routing valve 282. The pressure command module 505 generates a pressure command signal, $P_c$, 522, and also a sequence of times at which the air cylinder pressure output will be modified, and alternated between application sites on the body. The digital signal 511 that is generated is converted via a digital to analog converter 575 to an analog solenoid control signal 398 used to activate the routing valve 282.

The pressure command signal 522 is, in turn, used to derive a force command, $F_c$, 529 to the linear motor, which consists, of the sum of a feedforward component 527 generated by feedforward software module 525, and a feedback component 529 generated by feedback software module 530. The benefit of using a feedforward control signal is that pressure control is more accurate and robust in the presence of nonlinearities and uncertainty in the parameter, $K_p$, which follows from the fact that the linear motor is effectively controlled by the feedforward signal 525, and only a limited amount of correction needs to be provided by the feedback control signal 530. This allows the bandwidth of the feedback control loop to be maintained at a lower value, thereby greatly alleviating stability issues that could potentially arise from parameter uncertainties, nonlinearities and unmodeled high-frequency effects.

The software embedded in the processor 210 for controlling the pressure variation in air cylinder 360 is defined in greater detail as follows. The pressure command generator 505 outputs a commanded pressure, $P_c$, and the pressure transducer measures the actual pressure in the air cylinder forward chamber 340. The feedforward gain module 525 generates a control signal which is directly proportional to the commanded amplitude of the desired pressure variation, and inversely proportional to the nominal ratio of pressure amplitude to stroke amplitude for air cylinder 260. The feedback gain and compensation module 515 generates a control signal which is directly proportional to the difference between the commanded amplitude of the pressure variation and the actual pressure variation, $P_m$, as measured by the pressure transducer 250, The feedback gain and compensation module 515 would also typically incorporate a roll-off filter to reduce feedback loop responsiveness at high frequencies. An operation is included for adding the feedforward and feedback signals to yield a total force command signal to the linear motor 330. The total force command signal is converted via the digital-to-analog converter 215 into a control input signal 217 to the control electronics 230 which, in turn, generates a current, I, 232, to the linear motor 330. The force, F, 540 generated by the linear motor 330 causes the volume of the cylinder forward chamber 390 to vary, thereby leading to the pressure variation, P, 590, according to pressure response function 550. The pressure, P, 590, is measured by pressure transducer 250, as $P_m$, 258, which is converted by the analog-to-digital converter 205 into a digital signal for use in generating the feedback control signal.

In addition to Cystic Fibrosis and related pulmonary diseases, the application of controlled vibratory, constrictive and composite pressures to one or more sites on the body has potential benefits in the treatment of a diversity of other health conditions. The exposure of the human body to controlled pressures is beneficial in therapies such as cardio-pulmonary resuscitation, assisted breathing, enhanced blood circulation, and pain relief for those suffering from arthritis or a sports-related injury.

The embodiments described herein are sufficiently detailed to allow those skilled in the arts to practice the claimed invention, and it is understood that other embodiments may be utilized without departing from the true nature of the claimed invention.

What is claimed is:

1. A device for clearing mucus from the pulmonary system of a human, comprised of:

a pneumatic pressure generator for producing a time-varying pressure output;

a pressure control means whereby the temporal characteristics of said time-varying pressure output are regulated to conform to a desired pressure profile;

a pressure selection means whereby said pneumatic pressure generator is sequentially commanded to produce, over successive time intervals, and in an arbitrary order, a specific pressure variation including:

(a) a vibratory-pressure variation having a frequency spectrum substantially contained within the range 5 Hz to 20 Hz; and (b) a constrictive-pressure variation having a frequency spectrum substantially contained within the range 0 Hz to 5 Hz;

pressure channeling means, whereby said vibratory-pressure variation is channeled to a first pressure receiver configured to be in communication with an upper thorax of said human, and said constrictive-pressure variation is channeled to a second pressure receiver configured to be in communication with a lower thorax of said human; and a processor for implementing said pressure control means, said pressure selection means and said pressure channeling means.

2. The device of claim 1, wherein said pneumatic pressure generator is further comprised of:

an air cylinder having at least one output port for conveying said time-varying pressure output to said first pressure receiver and said second pressure receiver;

a linear motor for translating a moveable member within said air cylinder, whereby said time-varying pressure output is produced;

a diaphragm affixed to said moveable member and said air cylinder, said diaphragm providing an airtight seal between a forward and an aft chambers of said air cylinder; and a coupler connecting said linear motor to said moveable member.

3. The device of claim 2, wherein said linear motor is further comprised of:

an electrically energized forcer, and a permanent-magnet shaft; and drive electronics which converts an analog control signal into a voltage input to said forcer;

whereby relative linear displacement between said forcer and said permanent-magnet shaft compels translational motion of said moveable member.

4. The device of claim 1, wherein said pressure-control means is further comprised of:

a control console allowing a user or a caregiver to specify the temporal characteristics of a desired pressure output of said air cylinder;

a pressure transducer to measure said pressure in said forward chamber of said air cylinder;

analog to digital converter means for generating a digital realization of said pressure-transducer measurement;

a set of control algorithms embedded in said processor, said control algorithms operative upon said digital realization of said pressure-transducer measurement and said desired pressure output, and yielding a digital control signal for positioning said moveable member within said air cylinder; and a digital to analog converter for generating an analog voltage realization of said digital control signal.

5. The device of claim 2, further comprised of:

an air compressor in fluid communication with said aft chamber of said air cylinder;

an aft pressure transducer for measuring pressure in said aft chamber;

a venting valve for relieving air pressure in said aft chamber; and a set of algorithms embedded in said processor, operative upon said aft pressure transducer measurement, whereby control signals to regulate said air compressor and said venting valve are generated.

6. The device of claim 4, wherein said set of control algorithms is further comprised of:

a software module for generating a feedforward control signal, said feedforward signal being directly proportional to said desired value of pressure generator output;

a software module for generating a feedback control signal, said feedback control signal being directly proportional to the difference between said desired value of pressure generator output, and said pressure output measured by said pressure transducer; and a software module for summing said feedforward control signal and said feedback control signal, to yield said digital control signal.

7. The device of claim 1, wherein said pressure channeling means is further comprised of:

a routing valve allowing said vibratory pressure output of said air cylinder to be channeled to said upper thorax of said human body, and said constrictive pressure output of said air cylinder to be channeled to said lower thorax of said human body;

a timing function embedded in said processor which establishes successive times for activating said routing valve; and a signal provided by said processor for activating said routing valve.

8. The device of claim 7, wherein said routing valve is further comprised of:

a chamber having at least one input port in fluid communication with said at least one air cylinder output port, and having at least one output port;

a spool which allows air passage from said air cylinder output port through said at least one output port of said routing valve chamber;

a solenoid for positioning said spool within said routing valve; and a digital to analog converter for generating an analog realization of said signal provided by said processor for activating said routing valve.

9. The device of claim 8, further comprised of:

at least one air hose in fluid communication with said at least one output port of said routing valve chamber; and whereby said time-varying pressure output of said pneumatic pressure generator is conveyed to said first pressure receiver or said second pressure receiver.

* * * * *